US009880483B2

(12) United States Patent
Kitamura

(10) Patent No.: US 9,880,483 B2
(45) Date of Patent: Jan. 30, 2018

(54) IMAGE FORMING APPARATUS WITH CLEANING MODE USING AC VOLTAGE

(71) Applicant: CANON KABUSHIKI KAISHA, Tokyo (JP)

(72) Inventor: Takuya Kitamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/251,038

(22) Filed: Aug. 30, 2016

(65) Prior Publication Data

US 2017/0090330 A1 Mar. 30, 2017

(30) Foreign Application Priority Data

Sep. 25, 2015 (JP) ..... 2015-188330

(51) Int. Cl.
*G03G 15/02* (2006.01)

(52) U.S. Cl.
CPC ..... *G03G 15/0225* (2013.01); *G03G 15/0258* (2013.01); *G03G 15/0266* (2013.01)

(58) Field of Classification Search
CPC ..... G03G 15/0266; G03G 15/0225; G03G 15/0258
USPC ..... 399/50, 100
See application file for complete search history.

(56) References Cited

U.S. PATENT DOCUMENTS 8,041,249 B2 * 10/2011 Hara ..... G03G 21/0064 399/101
9,354,538 B2 5/2016 Seki et al.
2003/0049048 A1 * 3/2003 Yoshikawa ..... G03G 15/0225 399/129
2003/0194249 A1 * 10/2003 Kawamura ..... G03G 15/0225 399/100
2005/0078981 A1 * 4/2005 Ishiyama ..... G03G 15/0225 399/129
2007/0003315 A1 * 1/2007 Iwai ..... G03G 15/0258 399/100

FOREIGN PATENT DOCUMENTS

JP H04-371972 A 12/1992
JP 2000-235298 A 8/2000
JP 2002207354 A * 7/2002
JP 2002-311692 A 10/2002
JP 2007-148188 A 6/2007
(Continued)

*Primary Examiner* — Robert Beatty
(74) *Attorney, Agent, or Firm* — Fitzpatrick, Cella, Harper & Scinto

(57) ABSTRACT

Provided is an image forming apparatus including: an image bearing member; a charging member configured to charge the image bearing member; a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a period of the first AC voltage is different from a period of the second AC voltage.

8 Claims, 5 Drawing Sheets

(56) References Cited

FOREIGN PATENT DOCUMENTS

| | | | |
|---|---|---|---|
| JP | 2009-037053 | A | 2/2009 |
| JP | 2009-163221 | A | 7/2009 |
| JP | 2011-059378 | A | 3/2011 |
| JP | 2014-038259 | A | 2/2014 |
| JP | 2014-142533 | A | 8/2014 |
| JP | 2015-165271 | A | 9/2015 |

* cited by examiner

| NUMBER OF PERIODS | 8 | 12 | 16 | 20 | 24 |
|---|---|---|---|---|---|
| COMPARATIVE EXAMPLE | × | × | × | ○ | ○ |
| FIRST EMBODIMENT | × | ○ | ○ | ○ | ○ |

IMAGE FORMING APPARATUS WITH CLEANING MODE USING AC VOLTAGE

BACKGROUND OF THE INVENTION

Field of the Invention

The present invention relates to an image forming apparatus, e.g., a copying machine, a printer, or a facsimile machine, which uses an electrophotographic system or an electrostatic recording system.

Description of the Related Art

Hitherto, an electrophotographic image forming apparatus uniformly charges the surface of an image bearing member (hereinafter referred to as "photosensitive drum") to a desired potential with a charging member and exposes the charged surface with light in accordance with image information, to thereby form an electrostatic latent image.

Next, a developing device develops the electrostatic latent image with toner as a toner image. A transfer device transfers the toner image onto a recording material such as a sheet, and then the toner image is fixed onto the recording material with heat and pressure, to thereby obtain an output image. The toner remaining on the surface of the photosensitive drum after the transfer is collected by a cleaning member.

Charging members include a charging member of a contact charging type and a charging member of a corona charging type. In the contact charging type, the charging member having a voltage applied thereto is brought into contact with the surface of the photosensitive drum under predetermined pressing force, to thereby charge the surface of the photosensitive drum. In the contact charging type, the generation of ozone is significantly reduced as compared to that of the corona charging type.

When the charging member is brought into contact with the surface of the photosensitive drum, particles on the surface of the photosensitive drum, which have not been collected by the cleaning member, electrostatically adhere to the charging member.

When an adhering substance is accumulated on the charging member, the surface of the photosensitive drum suffers from a charging defect, with the result that an image defect, e.g., a streaked image, is generated in the toner image formed on the recording material.

In Japanese Patent Application Laid-Open No. H04-371972, a voltage, which has the same polarity as a normal voltage and is lower than the normal voltage, is applied to the charging member during non-image formation. With this, the adhering substance having an opposite polarity, which adheres to the charging member, is removed.

In Japanese Patent Application Laid-Open No. 2002-311692, a negative voltage and a positive voltage are respectively applied to the charging member during non-image formation at least once for at least a period of time required for one rotation of the charging member. With this, the adhering substance on the charging member is transferred onto the photosensitive drum to be removed.

Due to the recent increase in speed and longer operating life of a printer or a copying machine, and various use environments, stress to a toner tends to increase. When the stress to the toner increases, a reversed toner, which is charged to a polarity opposite to a normal polarity, and a negative external additive having a small particle diameter, which has been separated from the toner surface, increase to cause a problem in that bipolar particles adhere to the charging member.

In Japanese Patent Application Laid-Open No. H04-371972 and Japanese Patent Application Laid-Open No. 2002-311692, there are described the following problems. In Japanese Patent Application Laid-Open No. H04-371972, the adhering substance having an opposite polarity is removed, and hence the effect of removing the adhering substance having a normal polarity is insufficient.

In Japanese Patent Application Laid-Open No. 2002-311692, a bipolar voltage is applied. With this, a bipolar adhering substance is transferred onto the photosensitive drum. However, a power source configured to apply a bipolar charging voltage is required. With this, there is a problem of an increase in cost of the image forming apparatus.

Further, in Japanese Patent Application Laid-Open No. 2002-311692, there is disclosed a configuration in which a voltage having the same polarity as the charging voltage and ground connection are switched. For example, in a configuration in which the photosensitive drum is negatively charged, the application negative voltage state is switched to a ground connection. In this case, a potential difference between the surface potential of the photosensitive drum and the charging potential immediately after the switching is sufficiently ensured. Therefore, the positive adhering substance can be transferred. However, when a period of time elapses after the switching, the potential is fluctuated into a positive direction due to the dark decay of the surface potential of the photosensitive drum. With this, a sufficient potential difference cannot be ensured between the surface potential of the photosensitive drum and the charging potential, with the result that the positive adhering substance cannot be removed sufficiently.

In the case where a switching operation of the charging voltage is performed repeatedly, even when particles adhered to the charging member are transferred onto the photosensitive drum, the particles pass through the cleaning member to re-adhere to the charging member during a cleaning operation. The amount of particles adhering to the charging member can be reduced by extending the switching operation time of the charging voltage. However, when the operation time is extended, the photosensitive drum is degraded due to wearing and waiting time increases.

SUMMARY OF THE INVENTION

It is an object of the present invention to provide an image forming apparatus capable of removing an adhering substance that adheres to a charging member.

It is another object of the present invention to provide an image forming apparatus, including: an image bearing member; a charging member configured to charge the image bearing member; a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a period of the first AC voltage is different from a period of the second AC voltage.

It is another object of the present invention to provide an image forming apparatus, including: a charging member configured to charge the image bearing member; a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a duty ratio of the first AC voltage is different from a duty ratio of the second AC voltage.

Further features of the present invention will become apparent from the following description of exemplary embodiments with reference to the attached drawings.

DESCRIPTION OF THE EMBODIMENTS

Figure 1:
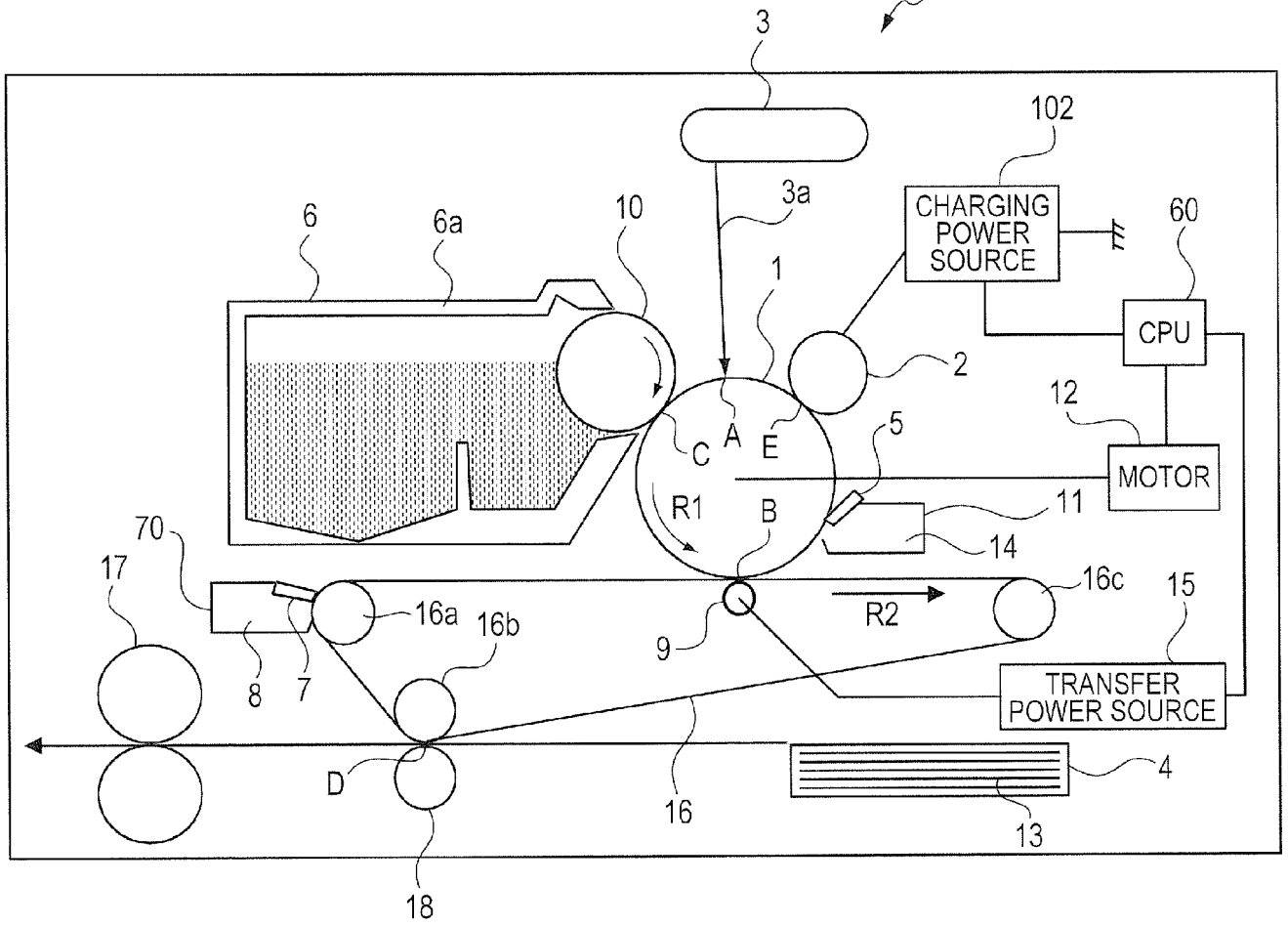
FIG. 1 is a sectional view for illustrating a configuration of an image forming apparatus according to a first embodiment of the present invention.

Referring to the drawings, an image forming apparatus according to embodiments of the present invention is specifically described.

[First Embodiment]

The configuration of an image forming apparatus according to a first embodiment is described with reference to FIG. 1 to FIG. 4. Sizes, materials, shapes, and relative arrangements of components described in each embodiment may be altered appropriately depending on various conditions or the configuration of an image forming apparatus to which the present invention is applied, and the scope of the present invention is not limited to the following embodiments.

<Image Forming Apparatus>

The configuration of the image forming apparatus according to the first embodiment is described with reference to FIG. 1. FIG. 1 is a sectional view for illustrating the configuration of the image forming apparatus according to the first embodiment.

In an image forming apparatus 100 illustrated in FIG. 1, a motor 12 serving as a drive source is driven and controlled by a central processing unit (CPU) 60 serving as a control unit. A photosensitive drum 1 serving as an image bearing member is rotated and driven in a direction indicated by the arrow R1 of FIG. 1 by the motor 12.

A charging roller 2 serving as a charging unit configured to uniformly charge the surface of the photosensitive drum 1 is arranged on the periphery of the photosensitive drum 1. Laser light 3*a* emitted from a laser scanner 3, which serves as an image exposure unit, in accordance with image information is radiated to an exposure position A on the surface of the photosensitive drum 1 that has been uniformly charged by the charging roller 2, to thereby form an electrostatic latent image on the surface of the photosensitive drum 1.

The electrostatic latent image formed on the surface of the photosensitive drum 1 with the laser light 3*a* emitted from the laser scanner 3 in accordance with the image information is supplied with a developer (toner) from a developing device 6 serving as a developing unit, thereby being developed as a toner image.

A developer container 6*a* of the developing device 6 accommodates a negatively charged toner. A developing roller 10 serving as a developer carrying member is arranged to a frame body of the developing device 6 in a rotatable manner. The developing roller 10 is arranged so as to be opposed to the surface of the photosensitive drum 1 and is brought into contact with a developing position C on the surface of the photosensitive drum 1.

The electrostatic latent image formed on the surface of the photosensitive drum 1 is supplied with a developer (toner) carried on the surface of the developing roller 10 at the developing position C on the surface of the photosensitive drum 1, thereby being developed as a toner image.

An intermediate transfer belt 16 serving as an intermediate transfer member, which is looped around so as to be rotatable in a direction indicated by the arrow R2 of FIG. 1 by tensioning rollers 16*a*, 16*b*, and 16*c*, is arranged so as to be opposed to the surface of the photosensitive drum 1.

A primary transfer roller 9 serving as a primary transfer unit is arranged on an inner peripheral surface side of the intermediate transfer belt 16 so as to be opposed to a primary transfer position B on the surface of the photosensitive drum 1. The primary transfer roller 9 is pressed against the primary transfer position B on the surface of the photosensitive drum 1 through intermediation of the intermediate transfer belt 16 by an urging unit (not shown).

With this, at the primary transfer position B corresponding to a primary transfer nip portion formed by the surface of the photosensitive drum 1 and the outer peripheral surface of the intermediate transfer belt 16, the surface of the photosensitive drum 1 and the outer peripheral surface of the intermediate transfer belt 16 are brought into contact with each other.

The toner image formed on the surface of the photosensitive drum 1 is primarily transferred onto the outer peripheral surface of the intermediate transfer belt 16 by the primary transfer roller 9.

A secondary transfer roller 18 serving as a secondary transfer unit is arranged so as to be opposed to the tensioning roller 16*b* configured to tension the intermediate transfer belt 16, and to hold the intermediate transfer belt 16 between the secondary transfer roller 18 and the tensioning roller 16*b*.

The toner image that has been primarily transferred onto the outer peripheral surface of the intermediate transfer belt 16 arrives at a secondary transfer position D corresponding to a secondary transfer nip portion formed by the secondary transfer roller 18 and the outer peripheral surface of the intermediate transfer belt 16. A recording material 13 accommodated in a sheet feed cassette 4 is fed to the secondary transfer position D by a feed part (not shown) in accordance with an arrival timing. The toner image that has been primarily transferred onto the outer peripheral surface of the intermediate transfer belt 16 is secondarily transferred onto the recording material 13 by the secondary transfer roller 18.

The recording material 13 onto which the unfixed toner image has been secondarily transferred is nipped and conveyed by a fixing roller and a pressure roller arranged in a fixing device 17 serving as a fixing unit. The heated and pressurized unfixed toner image is thermally melted to be thermally fixed onto the recording material 13 while being nipped and conveyed, and the recoding material 13 is discharged out of the image forming apparatus 100.

On a downstream side of the primary transfer position B on the surface of the photosensitive drum 1 in the rotational direction of the photosensitive drum 1 indicated by the arrow R1 of FIG. 1, a cleaning device 11 serving as a cleaning unit is arranged.

A residual toner remaining on the surface of the photosensitive drum 1 after the primary transfer is scraped off by a cleaning blade 5 arranged in the cleaning device 11 and collected into a waste toner container 14. The surface of the photosensitive drum 1 that has been cleaned by the cleaning device 11 is charged again by the charging roller 2.

On a downstream side of the secondary transfer position D in the rotational direction of the intermediate transfer belt 16 indicated by the arrow R2 of FIG. 1, a cleaner 70 serving as a cleaning unit is arranged. The residual toner remaining on the outer peripheral surface of the intermediate transfer belt 16 after the secondary transfer is scraped off by the cleaning blade 7 arranged in the cleaner 70 and collected into a waste toner container 8.

<Image Forming Operation>

The image forming operation of the image forming apparatus 100 is described. A normal image formation time refers to a time when an operation described below is performed. Specifically, charging processing by the charging roller 2 is performed in order to form an image on the recording material 13. Further, exposure processing by the laser scanner 3 and developing processing by the developing roller 10 are performed. Further, an image forming operation such as primary transfer processing by the primary transfer roller 9 and secondary transfer processing by the secondary transfer roller 18 is performed.

The surface of the photosensitive drum 1 that is being rotated at a circumferential speed of 140 mm/sec in the direction indicated by the arrow R1 of FIG. 1 is uniformly charged, by the charging roller 2, to a predetermined potential having the same polarity (negative polarity) as the toner. The laser light 3*a* emitted from the laser scanner 3 in accordance with image formation is radiated to the surface of the photosensitive drum 1 at the exposure position A, to thereby form an electrostatic latent image on the surface of the photosensitive drum 1.

The electrostatic latent image formed on the surface of the photosensitive drum 1 by the laser scanner 3 is supplied with a toner by the developing roller 10 arranged in the developing device 6 at the developing position C, thereby being developed as a toner image. The toner image formed on the surface of the photosensitive drum 1 is primarily transferred onto the outer peripheral surface of the intermediate transfer belt 16 by the primary transfer roller 9 at the primary transfer position B.

Specifically, a charging power source 102 applies a DC voltage of −1,100 V to the charging roller 2, to thereby uniformly charge the surface of the photosensitive drum 1 to −500 V. The laser scanner 3 irradiates the uniformly charged surface of the photosensitive drum 1 with the laser light 3*a* in accordance with the image information, to thereby form an electrostatic latent image on the surface of the photosensitive drum 1.

The developing roller 10 arranged in the developing device 6 causes a negatively charged toner to adhere to the electrostatic latent image corresponding to an exposure portion on the surface of the photosensitive drum 1 irradiated with the laser light 3*a*, to thereby develop the electrostatic latent image on the surface of the photosensitive drum 1 as a toner image through reversal development.

To a toner to be used in this embodiment, an external additive is added, such as silica for imparting flowability to the toner and titanium oxide for uniformizing the charge amount of the toner.

The charging roller 2 serving as a contact charging member is manufactured by forming a medium-resistance layer, which is formed of, for example, rubber or a foam, on the outer periphery of a conductive cored bar. The medium-resistance layer is made of a resin (urethane in this embodiment), conductive particles (e.g., carbon black), a sulfating agent, and a foaming agent and formed into a roller shape on the outer periphery of the cored bar. Then, the surface of the medium-resistance layer is polished.

The cleaning device 11 includes a cleaning blade 5 having elasticity, which includes a sheet metal and a chip blade made of a urethane rubber serving as a cleaning member. The cleaning blade 5 is arranged so that a tip end portion thereof is in abutment against the surface of the photosensitive drum 1 in a counter direction of the rotational direction of the photosensitive drum 1 (rotational direction of the image bearing member) indicated by the arrow R1 of FIG. 1.

The residual toner remaining on the surface of the photosensitive drum 1 after the primary transfer is scraped off by the cleaning blade 5 and collected into the waste toner container 14. The physical properties of the cleaning blade 5 change under a low-temperature and low-humidity environment. With this, more than a few particles pass through the cleaning blade 5.

As the kind of particles that pass through the cleaning blade 5, specifically, there are given a reversed toner that is charged to a polarity opposite to a normal polarity, and a negative external additive having a small particle diameter, which has been separated from the toner surface.

In general, the transfer residual toner mainly includes positively charged particles. The charging voltage applied to the charging roller 2 has a negative polarity. With this, the positively charged particles adhere to the surface of the charging roller 2.

The external additive added to a toner is separated from the toner in the developing device 6 and is transferred onto the surface of the photosensitive drum 1 due to fogging, or the external additive is separated from the toner scraped off by the cleaning blade 5 and is transferred onto the surface of the photosensitive drum 1.

The external additive separated from the toner has a particle diameter smaller than the toner. Therefore, the external additive can easily pass through the cleaning blade 5. The negative external additive having passed through the cleaning blade 5 adheres to positively charged particles that have already adhered to the surface of the charging roller 2 or adheres to the surface of the charging roller 2 under a state in which the potential of the charging roller 2 is low.

Thus, the particles having passed through the cleaning blade 5 electrostatically adhere to the surface of the charging roller 2. Therefore, in this embodiment, the adhering substance that adheres to the surface of the charging roller 2 is electrostatically transferred onto the surface of the photosensitive drum 1 in a cleaning mode for the charging roller 2.

<Cleaning Mode>

The cleaning mode of the image forming apparatus 100, in which the charging roller 2 is cleaned during non-image formation, is described. The photosensitive drum 1 is rotated in the direction indicated by the arrow R1 of FIG. 1 so that its surface is moved, and in this state, a cleaning voltage Vc that is an AC voltage is applied to the charging roller 2 serving as the charging unit by the charging power source 102 serving as a voltage applying device. With this, the charging roller 2 is cleaned.

The non-image formation time in this embodiment refers to a pre-rotation time before the start of the image forming operation and a post-rotation time after the end of the image forming operation. In this embodiment, the cleaning mode for the charging roller 2 is performed by the CPU 60 serving as the control unit during the post-rotation time.

The CPU 60 controls the rotation of the motor 12 serving as a drive source for rotating and driving the photosensitive drum 1 and controls the charging power source 102.

Figure 2:
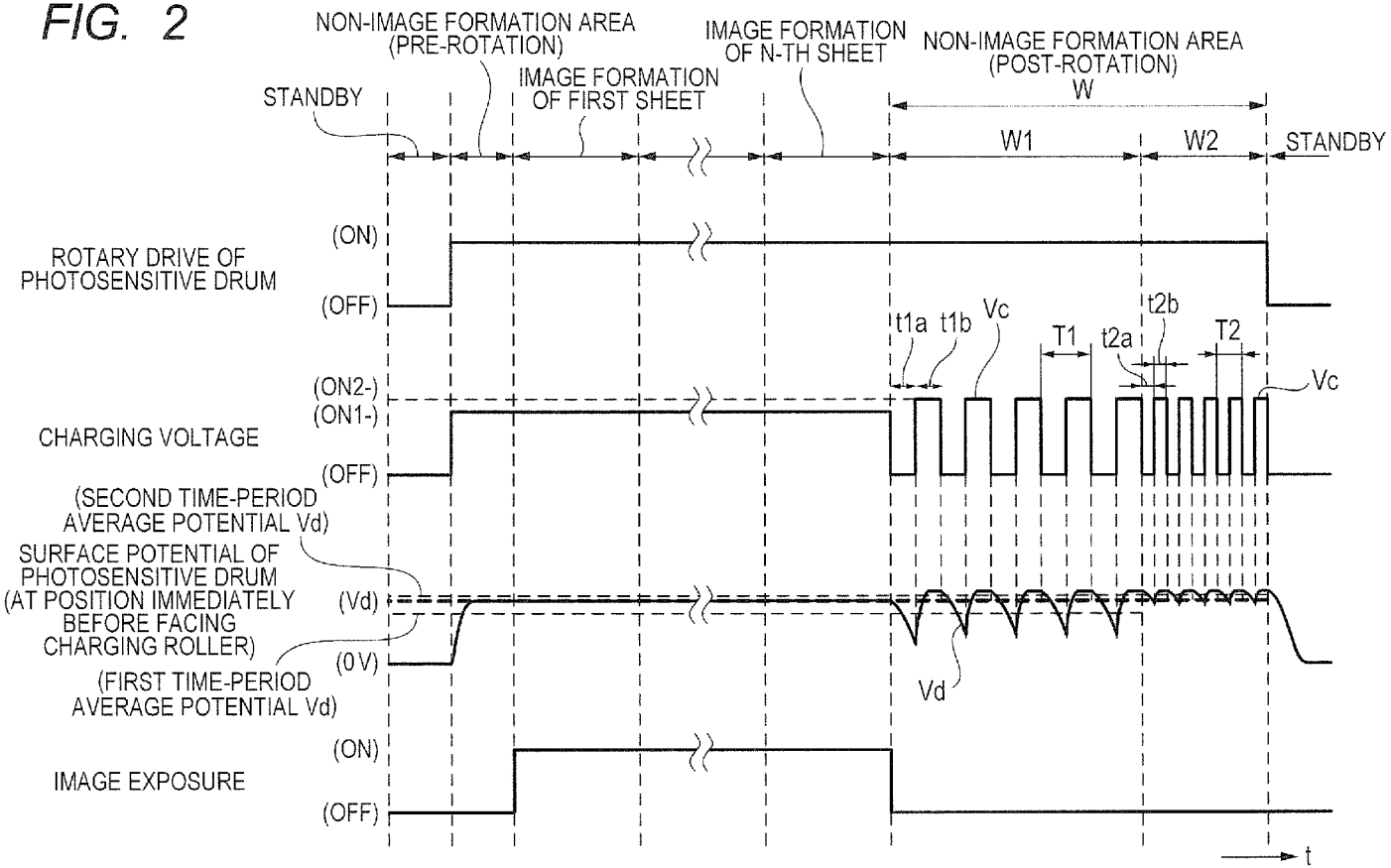
FIG. 2 is a timing chart of an image forming operation of the image forming apparatus according to the first embodiment.
Figures 3, 4:
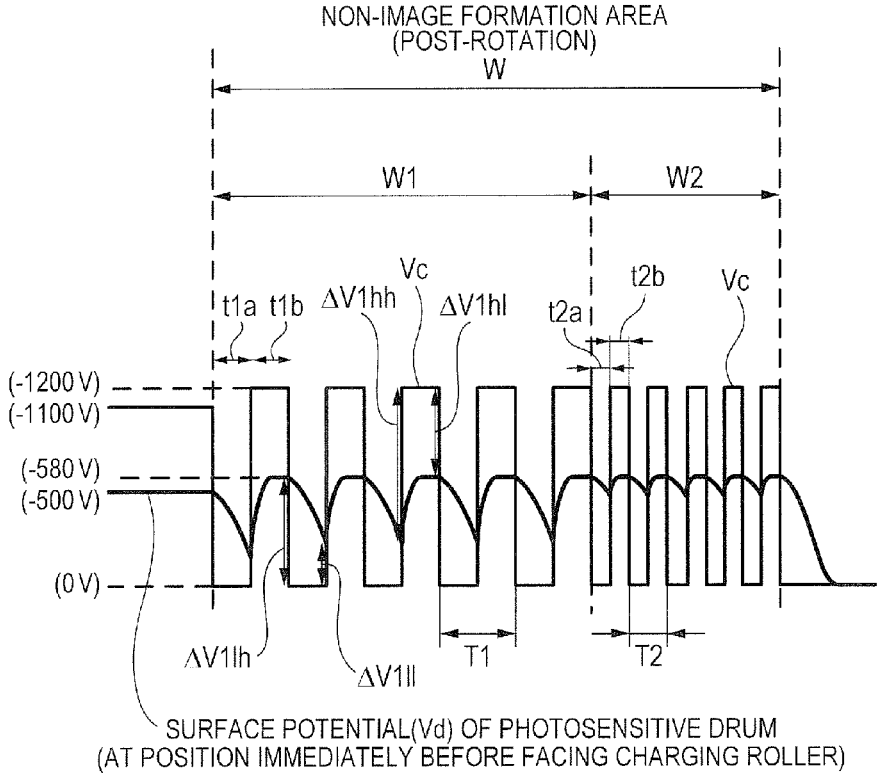
FIG. 3 is a chart for illustrating a relationship between a surface potential of an image bearing member and an AC voltage in a cleaning mode for a charging roller 2 according to the first embodiment.
FIG. 4 is a table for showing evaluation of a streaked image generated in a toner image formed on a recording material due to contamination of a charging unit after a total of 5,000 sheets have been printed by repeating an operation of continuously printing 20 sheets of an A4-size recording material.

The cleaning mode for the charging roller 2 according to this embodiment is described with reference to FIG. 2 and FIG. 3. FIG. 2 is a timing chart of the image forming operation of the image forming apparatus 100 according to this embodiment. FIG. 3 is a chart for illustrating a relationship between a surface potential Vd of the photosensitive drum 1 and the cleaning voltage Vc that is an AC voltage and is applied from the charging power source 102 to the charging roller 2 in the cleaning mode for the charging roller 2 according to this embodiment.

As illustrated in FIG. 2 and FIG. 3, during the post-rotation performed after the end of the image forming operation of the image forming apparatus 100, the CPU 60 serving as the control unit performs the cleaning mode of cleaning the charging roller 2. The cleaning voltage Vc that is an AC voltage and is applied from the charging power source 102 to the charging roller 2 is switched on/off alternately at least once by the CPU 60.

In this embodiment, the cleaning voltage Vc that is an AC voltage and is applied from the charging power source 102 to the charging roller 2 in the cleaning mode for the charging roller 2 was set to 0 V at a time of OFF and −1,200 V at a time of ON.

The transfer voltage applied from a transfer power source 15 to the primary transfer roller 9 in the cleaning mode for the cleaning roller 2 can be set to 0 V or a negative voltage.

When the positive transfer voltage is applied to the primary transfer roller 9, the surface potential Vd described below is obtained. The surface potential Vd of the photosensitive drum 1 that has arrived at a position immediately before a charging position E on the surface of the photosensitive drum 1 to which the charging roller 2 is opposed, on an upstream side in the rotational direction of the photosensitive drum 1 indicated by the arrow R1 of FIG. 1 is negatively charged in the vicinity of 0 V or positively charged.

Therefore, a potential difference ΔV between the surface potential Vd of the photosensitive drum 1 in the cleaning mode for the charging roller 2 and the cleaning voltage Vc that is an AC voltage and is applied to the charging roller 2 illustrated in FIG. 3 is considered. Due to the potential difference ΔV, there is a risk in that an electric field for transferring the positively charged particles adhered to the surface of the charging roller 2 onto the surface of the photosensitive drum 1 may not be formed sufficiently.

In this embodiment, the transfer voltage applied from the transfer power source 15 to the primary transfer roller 9 in the cleaning mode for the charging roller 2 was set to −800 V.

During a first time-period W1 and a second time-period W2 of a cleaning mode time-period W (during time-period) illustrated in FIG. 2 and FIG. 3, the cleaning voltage Vc that is an AC voltage and is applied from the charging power source 102 serving as the voltage applying device to the charging roller 2 is as described below. That is, periods t1*a* and t1*b* and periods t2*a* and t2*b* at a time of OFF and ON of the cleaning voltage Vc are set so as to have a period of time equal to or longer than at least a period of time required for one rotation of the charging roller 2.

In this embodiment, the respective periods t1*a* and t1*b* (t1*a*=t1*b*) and the respective periods t2*a* and t2*b* (t2*a*=t2*b*), at a time of OFF and a time of ON of the cleaning voltage Vc that is an AC voltage, are different between the first time-period W1 and the second time-period W2.

In the cleaning mode time-period W illustrated in FIG. 2 and FIG. 3, the cleaning mode, in which ON and OFF of the cleaning voltage Vc are respectively performed once, is defined as one period T. Then, one period T1 (=t1*a*+t1*b*) of the cleaning voltage Vc during the first time-period W1 is different from one period T2 (=t2*a*+t2*b*) of the cleaning voltage Vc during the second time-period W2.

That is, a frequency f1 (=1/T1) during the first time-period W1 of the cleaning voltage Vc that is an AC voltage is different from a frequency f2 (=1/T2) during the second time-period W2 of the cleaning voltage Vc that is an AC voltage.

In this embodiment, the period t1*a* at a time of OFF of the cleaning voltage Vc during the first time-period W1 as a first AC voltage is set to a period of time required for one rotation of the photosensitive drum 1. The period t1*b* at a time of ON of the cleaning voltage Vc during the first time-period W1 is the same period of time as that of the period t1*a* at a time of OFF of the cleaning voltage Vc (t1*a*=t1*b*).

The period t2*a* at a time of OFF of the cleaning voltage Vc during the second time-period W2 as a second AC voltage is set to a period of time required for one rotation of the charging roller 2. The period t2*b* at a time of ON of the cleaning voltage Vc during the second time-period W2 is the same period of time as that of the period t2*a* at a time of OFF of the cleaning voltage Vc (t2*a*=t2*b*).

A period of time required for one rotation of the charging roller 2 is shorter than a period of time required for one rotation of the photosensitive drum 1. With this, a relationship represented by Expression (1) holds.

$$t1a=t1b>t2a=t2b \qquad \text{Expression (1)}$$

The frequency f1 (=1/T1=1/(t1*a*+t1*b*)) of the cleaning voltage Vc during the first time-period W1 and the frequency f2 (=1/T2=1/(t2*a*+tb2)) of the cleaning voltage Vc during the second time-period W2 have a relationship represented by Expression (2).

$$f1<f2 \qquad \text{Expression (2)}$$

During the first time-period W1 and the second time-period W2 of the cleaning voltage Vc that is an AC voltage, the cleaning mode for one or more period T1 and one or more period T2 can be performed respectively. In this embodiment, the cleaning mode for five periods (T1×5, T2×5) is performed during both the first time-period W1 and the second time-period W2.

The charging position E to which the charging roller 2 is opposed in the cleaning mode for the charging roller 2 represented in the cleaning mode time-period W of FIG. 3 is considered. A relationship between the surface potential Vd of the photosensitive drum 1 at a position immediately before the charging position E on an upstream side in the rotational direction of the photosensitive drum 1 and the cleaning voltage Vc is described.

When the cleaning voltage Vc in the cleaning mode for the charging roller 2 represented in the cleaning mode time-period W of FIG. 3 is OFF (0 V), a relationship between the surface potential Vd and the cleaning voltage Vc is as described below. That is, the surface potential Vd of the photosensitive drum 1 at a position immediately before the charging position E, to which the charging roller 2 is opposed, on an upstream side in the rotational direction of the photosensitive drum 1 and the cleaning voltage Vc satisfy a relationship represented by Expression (3).

$$Vd<Vc \qquad \text{Expression (3)}$$

In this case, an electric field for transferring positively charged particles adhered to the surface of the charging roller 2 onto the surface of the photosensitive drum 1 is formed. With this, the positively charged particles adhered to the surface of the charging roller 2 can be transferred onto the surface of the photosensitive drum 1.

The positively charged particles transferred onto the surface of the photosensitive drum 1 are scraped off by the cleaning blade 5 and collected into the waste toner container 14. Alternatively, after the particles are transferred onto the outer peripheral surface of the intermediate transfer belt 16, the particles are scraped off by the cleaning blade 7 and collected into the waste toner container 8.

When the cleaning voltage Vc in the cleaning mode for the charging roller 2 represented in the cleaning mode time-period W of FIG. 3 is ON (−1,200 V), a relationship between the surface potential Vd and the cleaning voltage Vc is as described below. The surface potential Vd of the photosensitive drum 1 at a position immediately before the charging position E, to which the charging roller 2 is opposed, on an upstream side in the rotational direction of the photosensitive drum 1 and the cleaning voltage Vc satisfy a relationship represented by Expression (4).

$$Vd>Vc \qquad \text{Expression (4)}$$

With this, an electric field for transferring negatively charged particles adhered to the surface of the charging roller 2 onto the surface of the photosensitive drum 1 is formed. With this, the negatively charged particles adhered to the surface of the charging roller 2 can be transferred onto the surface of the photosensitive drum 1.

The negatively charged particles transferred onto the surface of the photosensitive drum 1 are scraped off by the cleaning blade 5 and collected into the waste toner container 14. Alternatively, after the particles are transferred onto the outer peripheral surface of the intermediate transfer belt 16, the particles are scraped off by the cleaning blade 7 and collected into the waste toner container 8.

Description is given of an action during the first time-period W1 and the second time-period W2 in which the frequencies f1 and f2 of the cleaning voltage Vc are different. Regarding the cleaning voltage Vc in the cleaning mode for the charging roller 2 represented in the cleaning mode time-period W of FIG. 3, the frequency f1 (=1/T1) during the first time-period W1 and the frequency f2 (=1/T2) during the second time-period W2 is represented by Expression (2).

As illustrated in FIG. 3, in the surface potential Vd of the photosensitive drum 1 at a time when the cleaning voltage Vc is OFF (0V), dark decay occurs, in which the charging potential decreases (charge amount is reduced) with the passage of time.

Therefore, a potential difference ΔV11*h* between the surface potential Vd of the photosensitive drum 1 immediately after the switching of the cleaning voltage Vc during the first time-period W1 from the ON (−1,200 V) state to the OFF (0 V) state and the cleaning voltage Vc is considered. In the potential difference ΔV11*h*, an electric field having an action of transferring the positively charged particles adhered to the surface of the charging roller 2 onto the surface of the photosensitive drum 1 is large.

A potential difference ΔV111 between the surface potential Vd of the photosensitive drum 1 immediately before the switching of the cleaning voltage Vc during the first time-period W1 from the OFF (0 V) state to the ON (−1,200 V) state and the cleaning voltage Vc is smaller than the potential difference ΔV11*h*.

A potential difference ΔV1*hh* between the surface potential Vd of the photosensitive drum 1 immediately after the switching of the cleaning voltage Vc during the first time-period W1 from the OFF (0 V) state to the ON (−1,200 V) state and the cleaning voltage Vc is considered. In the potential difference ΔV1*hh*, an electric field having an action of transferring the negatively charged particles adhered to the surface of the charging roller 2 onto the surface of the photosensitive drum 1 is significantly large.

A potential difference ΔV1*h*1 between the surface potential Vd of the photosensitive drum 1 immediately before the switching of the cleaning voltage Vc during the first time-period W1 from the ON (−1,200 V) state to the OFF (0 V) state and the cleaning voltage Vc is considered. Also in the potential difference ΔV1*h*1, an electric field having an action of transferring the negatively charged particles adhered to the surface of the charging roller 2 onto the surface of the photosensitive drum 1 is sufficiently ensured.

Thus, during the first time-period W1 of the cleaning mode time-period W of FIG. 3, an electric field described below is formed. That is, an electric field is formed, which actively transfers, among the particles adhered to the surface of the charging roller 2, the negatively charged particles onto the surface of the photosensitive drum 1 rather than the positively charged particles.

During the second time-period W2 of the cleaning mode time-period W of FIG. 3, the frequency f2 of the cleaning voltage Vc is larger than the frequency f1 of the cleaning voltage Vc during the first time-period W1.

Thus, the application time for one period during the second time-period W2 (time of the second time-period W2) of the cleaning voltage Vc that is an AC voltage and is applied to the charging roller 2 is shorter than the application time for one period during the first time-period W1 (time of the first time-period W1).

With this, the dark decay amount during a decrease in charging potential of the surface of the photosensitive drum 1 at a time when the cleaning voltage Vc is OFF (0 V) is smaller during the second time-period W2 as compared to that during the first time-period W1. With this, an electric field having an action of transferring the positively charged particles adhered to the surface of the charging roller 2 onto the surface of the photosensitive drum 1 is sufficiently ensured.

In this embodiment, during the first time-period W1 of the cleaning mode time-period W of FIG. 3, an electric field for actively removing the negatively charged particles among the particles adhered to the surface of the charging roller 2 is generated. That is, during the first time-period W1, among the particles adhered to the surface of the charging roller 2, the negatively charged particles are mainly transferred onto the photosensitive drum 1.

Further, during the second time-period W2, an electric field capable of sufficiently removing the positively charged particles among the particles adhered to the surface of the charging roller 2 is generated as compared to the first time-period W1. That is, during the second time-period W2, among the particles adhered to the surface of the charging roller 2, the positively charged particles are mainly transferred onto the photosensitive drum 1.

In the cleaning mode for the charging roller 2 represented in the cleaning mode time-period W of FIG. 3, the frequency f of the cleaning voltage Vc that is an AC voltage and is applied to the charging roller 2 is set so as to be different between the first time-period W1 and the second time-period W2.

With this, among the particles adhered to the surface of the charging roller 2, the polarity of the particles to be removed can be selected. As a result, the bipolar particles adhered to the surface of the charging roller 2 can be removed effectively in a short period of time.

In order to confirm the effects of this embodiment, an operation of continuously printing 20 sheets of the recording material 13 of an A4 size was performed repeatedly, to thereby print a total of 5,000 sheets of the recording material 13. Then, a streaked image generated in a toner image printed on the recording material 13 due to the contamination of the surface of the charging roller 2 was confirmed.

Symbol "x" of FIG. 4 indicates that a streaked image generated in a toner image printed on the recording material 13 was visually confirmed. Symbol "○" of FIG. 4 indicates that a streaked image generated in a toner image printed on the recording material 13 was not visually confirmed.

The cleaning mode for the charging roller 2 represented in the cleaning mode time-period W of FIG. 2 and FIG. 3 was performed during each post-rotation time corresponding to a non-image formation time after 20 sheets of the recording material 13 of an A4 size were continuously printed.

In Comparative Example shown in FIG. 4, a cleaning mode for the charging roller 2 in the cleaning mode time-period W represented in FIG. 2 and FIG. 3 was performed as described below. Specifically, during the entire cleaning mode time-period W, the cleaning mode was performed with the number of a plurality of periods T1 (number of periods) through use of only the cleaning voltage Vc with the frequency f1 during the first time-period W1.

In Embodiment 1 shown in FIG. 4, the cleaning mode for the charging roller 2 in the cleaning mode time-period W represented in FIG. 2 and FIG. 3 was performed as described below. Specifically, in the former half of the cleaning mode time-period W, the first time-period W1 for applying the cleaning voltage Vc with the frequency f1 to the charging roller 2 was provided. Further, in the latter half of the cleaning mode time-period W, the second time-period W2 for applying the cleaning voltage Vc with the frequency f2 (>f1) to the charging roller 2 was provided.

The respective numbers of the periods T1 and T2 (numbers of periods) of the cleaning voltage Vc were set to be the same between the first time-period W1 and the second time-period W2, and under this condition, the cleaning mode was performed. In FIG. 4, a total number of the periods T1 and T2 of the cleaning voltage Vc during the first time-period W1 and the second time-period W2 is shown.

As shown in FIG. 4, in Example 1, the effect of suppressing the contamination of the surface of the charging roller 2 with the number of periods smaller than that of Comparative Example was obtained. Thus, in Example 1, a total number of the periods T1 and T2 of the cleaning voltage Vc can be made smaller than that of Comparative Example under the condition that the suppression of the contamination of the surface of the charging roller 2 is at the same level. Therefore, the rotation distance of the outer peripheral surface of the photosensitive drum 1 can be reduced.

With this, in the configuration including the charging roller 2 that is brought into contact with the surface of the photosensitive drum 1 to charge the photosensitive drum 1, the effects described below are obtained. Specifically, stable charging performance can be kept over a long period of time while the occurrence of an image defect, such as a streaked image generated due to the accumulation of a bipolar adhering substance that electrostatically adheres to the surface of the charging roller 2, is prevented, to thereby output a high quality image.

In this embodiment, an example of the cleaning voltage Vc that is an AC voltage and is applied in the cleaning mode for the charging roller 2 is described. Besides this, the cleaning voltage Vc that is an AC voltage having various waveforms can be applied depending on the charging characteristics or abundance ratio of the adhering particles that are intended to be removed and the surface potential characteristics of the photosensitive drum 1.

In this embodiment, the cleaning mode for the charging roller 2 was performed during the post-rotation time after the image forming operation as an example of the non-image formation time. Besides this, the cleaning mode for the charging roller 2 may be performed during the non-image formation time, such as the pre-rotation time before the image forming operation.

In this embodiment, during the first time-period W1 of the cleaning mode time-period W of FIG. 2 and FIG. 3, the negatively charged particles adhered to the surface of the charging roller 2 are transferred onto the surface of the photosensitive drum 1 to be removed.

Further, during the second time-period W2, the positively charged particles adhered to the surface of the charging roller 2 are transferred onto the surface of the photosensitive drum 1 to be removed. Thus, the particles having a polarity to be removed are selected between the first time-period W1 and the second time-period W2.

Besides this, the order of the polarity of the particles that are intended to be removed may be changed between the first time-period W1 and the second time-period W2. In this case, the order of the frequencies f1 and f2 of the cleaning voltage Vc that is an AC voltage and is applied to the charging roller 2 may be replaced between the first time-period W1 and the second time-period W2 of the cleaning mode time-period W of FIG. 2 and FIG. 3.

The bipolar adhering substance electrostatically adhering to the surface of the charging roller 2 that is brought into contact with the surface of the photosensitive drum 1 to charge the photosensitive drum 1 is removed efficiently. With this, a high quality image is obtained over a long period of time.

As described above, in the configuration including the charging roller 2 that is brought into contact with the surface of the photosensitive drum 1 to charge the photosensitive drum 1, the effects described below are obtained. Specifically, stable charging performance can be kept over a long period of time while the occurrence of an image defect, such as a streaked image generated due to the accumulation of a bipolar adhering substance that electrostatically adheres to the surface of the charging roller 2, is prevented, to thereby output a high quality image.

[Second Embodiment]

A configuration of an image forming apparatus according to a second embodiment of the present invention is described with reference to FIG. 5. A configuration similar to that of the first embodiment is denoted by the same reference symbol or the same component name with different reference symbol as that of the first embodiment, and the description thereof is omitted.

In the first embodiment, the frequencies f1 and f2 of the cleaning voltage Vc that is an AC voltage and is applied to the charging roller 2 are changed between the first time-period W1 and the second time-period W2 in the cleaning mode for the charging roller 2.

With this, the polarity of the particles to be removed from the surface of the charging roller 2 was selected between the first time-period W1 and the second time-period W2.

In addition to the configuration of the first embodiment, this embodiment has the configuration described below during the first time-period W1 and the second time-period W2 of the cleaning mode time-period W of FIG. 5. Specifically, the circumferential speed of the photosensitive drum 1 that is rotated in the direction indicated by the arrow R1 of FIG. 1 (movement speed of the surface of the image bearing member) is different.

A cleaning mode for the charging roller 2 according to this embodiment is described with reference to FIG. 5. FIG. 5 is a timing chart of an image forming operation according to this embodiment.

Figure 5:
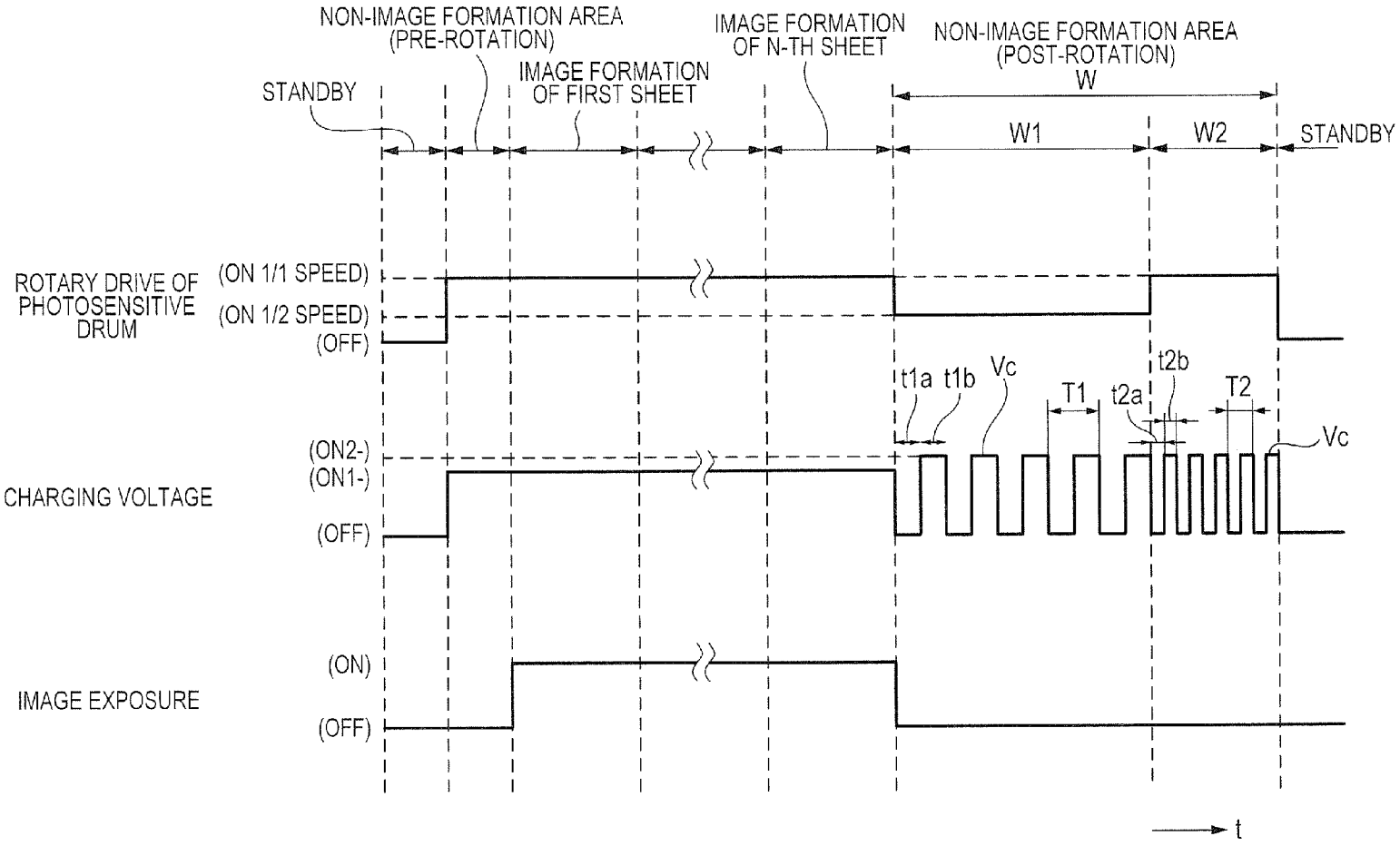
FIG. 5 is a timing chart of an image forming operation of an image forming apparatus according to a second embodiment of the present invention.

The cleaning voltage Vc that is an AC voltage and is applied to the charging roller 2 is set in the same way as in the first embodiment between the first time-period W1 and the second time-period W2 of the cleaning mode time-period W of FIG. 5.

In this embodiment, the circumferential speed of the photosensitive drum 1 during the second time-period W2 is set to 1/1 speed (140 mm/sec). The circumferential speed of the photosensitive drum 1 during the first time-period W1 was set to 1/2 speed (70 mm/sec=(140 mm/sec)/2).

The period t1*a* (time) at a time of OFF (0 V) of the cleaning voltage Vc during the first time-period W1 is set to a period of time required for one rotation of the photosensitive drum 1.

The period t1*b* (time) at a time of ON (−1,200 V) of the cleaning voltage Vc during the first time-period W1 is the same period of time as the period t1*a* (time) at a time of OFF (0 V) (t1*a*=t1*b*).

In this embodiment, the period t2*a* (time) at a time of OFF (0 V) of the cleaning voltage Vc during the second time-period W2 is also set to a period of time required for one rotation of the photosensitive drum 1.

The period t2*b* (time) at a time of ON (−1,200 V) of the cleaning voltage Vc during the second time-period W2 is the same period of time as the period t2*a* (time) at a time of OFF (0 V) (t2*a*=t2*b*).

In this embodiment, the circumferential speed of the photosensitive drum 1 that is rotated and driven during the first time-period W1 and that during the second time-period W2 have a relationship of 1:2. Therefore, the OFF time and the ON time of the cleaning voltage Vc during the first time-period W1 and the second time-period W2 have a relationship of 2:1 as represented by Expression (5).

$$t1a=t1b=t2a\times 2=t2b\times 2 \qquad \text{Expression (5)}$$

Thus, the OFF time and the ON time have a relationship represented by Expression (6).

$$t1a=t1b>t2a=t2b \qquad \text{Expression (6)}$$

The frequency f1 of the cleaning voltage Vc during the first time-period W1 and the frequency f2 of the cleaning voltage Vc during the second time-period W2 have a relationship represented by Expression (7).

$$f1<f2 \qquad \text{Expression (7)}$$

In this embodiment, in the same way as in the first embodiment, the frequency f1 of the cleaning voltage Vc during the first time-period W1 and the frequency f2 of the cleaning voltage Vc during the second time-period W2 have a relationship represented by Expression (7).

With this, during the first time-period W1, an electric field for actively removing the negatively charged particles among the particles adhered to the surface of the charging roller 2 is formed.

During the second time-period W2, an electric field capable of sufficiently removing the positively charged particles among the particles adhered to the surface of the charging roller 2 is formed as compared to the first time-period W1.

With this, the behavior of the cleaning blade 5 is stabilized while the negatively charged external additive having a small particle diameter, which is difficult to be cleaned, is removed actively during the first time-period W1. Then, the circumferential speed of the photosensitive drum 1 at which the scrape-off performance by the cleaning blade 5 is enhanced is decreased, and the negatively charged particles transferred from the surface of the charging roller 2 onto the surface of the photosensitive drum 1 can be efficiently scraped off by the cleaning blade 5.

During the second time-period W2, the positive particles, which are easy to be cleaned, are scraped off with the cleaning blade 5 by increasing the circumferential speed of the photosensitive drum 1 while removing the particles. With this, the positive particles transferred from the surface of the charging roller 2 onto the surface of the photosensitive drum 1 can be removed efficiently in a short period of time.

The frequencies f1 and f2 of the cleaning voltage Vc that is an AC voltage and is applied to the charging roller 2 are changed between the first time-period W1 and the second time-period W2. Further, the circumferential speed of the photosensitive drum 1 is changed.

With this, the bipolar particles adhered to the surface of the charging roller 2 can be collected at an efficient cleaning speed, and stable charging performance can be kept over a long period of time while the occurrence of an image defect, such as a streaked image, is prevented, to thereby output a high quality image.

In this embodiment, the circumferential speed of the photosensitive drum 1 during the first time-period W1 is set to a low speed, and the circumferential speed of the photosensitive drum 1 during the second time-period W2 is set to a high speed. Besides this, the circumferential speed of the photosensitive drum 1 and the switching order of the circumferential speed can be selected appropriately depending on the particles of a polarity that is intended to be cleaned efficiently. The other configuration is the same as that of the first embodiment, and the same effects can be obtained.

[Third Embodiment]

A configuration of an image forming apparatus according to a third embodiment of the present invention is described with reference to FIG. 6. A configuration similar to that of each of the embodiments is denoted by the same reference symbol or the same component name with different reference symbol as that of each of the embodiments, and the description thereof is omitted.

In the first embodiment, the frequencies f1 and f2 of the cleaning voltage Vc that is an AC voltage and is applied to the charging roller 2 are changed between the first time-period W1 and the second time-period W2 in the cleaning mode for the charging roller 2.

With this, the polarity of the particles to be removed from the surface of the charging roller 2 is selected between the first time-period W1 and the second time-period W2.

In this embodiment, unlike the first embodiment, the frequencies f1 and f2 of the cleaning voltage Vc that is an AC voltage and is applied to the charging roller 2 are constant (the same) between the first time-period W1 and the second time-period W2.

Meanwhile, the duty ratio of the pulse-shaped cleaning voltage Vc that is an AC voltage and is applied to the charging roller 2 is different between the first time-period W1 and the second time-period W2. The duty ratio is obtained by dividing the pulse width (time-period during which the cleaning voltage Vc is ON) of the pulse-shaped cleaning voltage Vc that is an AC voltage and is applied to the charging roller 2 by a pulse period (sum of the time-period during which the cleaning voltage Vc is ON and the time-period during which the cleaning voltage Vc is OFF).

A cleaning mode for the charging roller 2 according to this embodiment is described with reference to FIG. 6. FIG. 6 is a timing chart of an image forming operation according to this embodiment.

Figure 6:
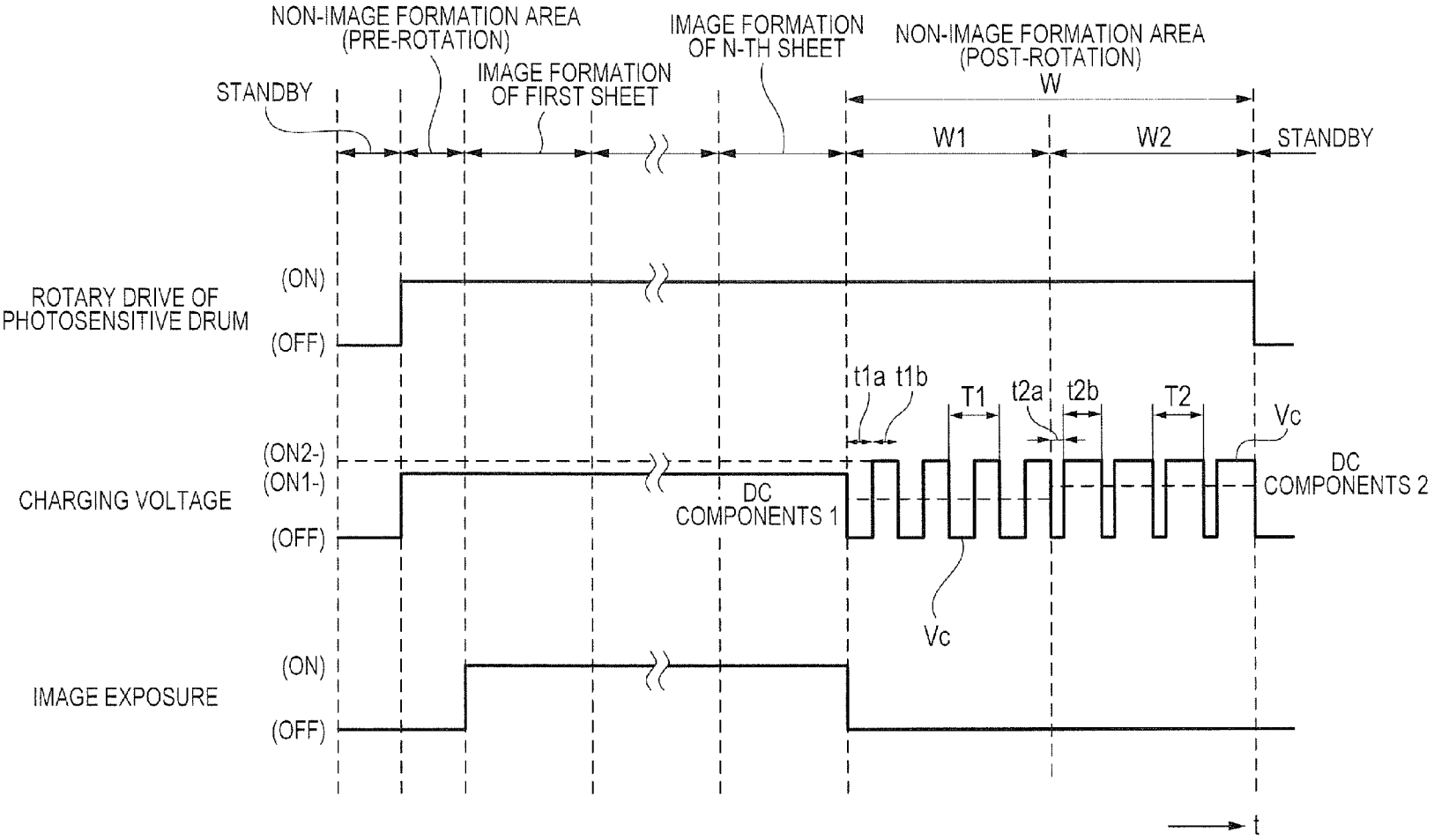
FIG. 6 is a timing chart of an image forming operation of an image forming apparatus according to a third embodiment of the present invention.

In this embodiment, the cleaning voltage Vc that is an AC voltage and is applied to the charging roller 2 is set to 0 V at a time of OFF during the first time-period W1 and the second time-period W2 of the cleaning mode time-period W of FIG. 6. Further, the cleaning voltage Vc at a time of ON is set to −1,200 V.

The period t1*a* (time) at a time of OFF of the cleaning voltage Vc during the first time-period W1 as the first AC voltage and the period t1*b* (time) at a time of ON thereof are the same and are set to a period of time required for one rotation of the photosensitive drum 1.

The period t2*a* (time) at a time of OFF of the cleaning voltage Vc during the second time-period W2 as the second AC voltage is set to a period of time required for one rotation of the charging roller 2. The period t2*b* (time) at a time of ON of the cleaning voltage Vc during the second time-period W2 is a period of time obtained by subtracting the period t2*a* at a time of OFF of the second time-period W2 from one period T1 (=T2) of the cleaning voltage Vc during the first time-period W1.

As a result, the period t2*b* (time) at a time of ON of the cleaning voltage Vc during the second time-period W2 according to this embodiment is set to a period of time longer than a period of time required for one rotation of the photosensitive drum 1. Thus, the duty ratio between the ON time and the OFF time of the cleaning voltage Vc is different between the first time-period W1 and the second time-period W2. The frequencies f1 and f2 of the cleaning voltage Vc during the first time-period W1 and the second time-period W2 have a relationship represented by Expression (8).

$$f1=f2 \qquad \text{Expression (8)}$$

In this embodiment, the period t2*a* (time) at a time of OFF of the cleaning voltage Vc during the second time-period W2 is shorter than the period t1*a* (time) at a time of OFF of the cleaning voltage Vc during the first time-period W1.

With this, the dark decay amount during a decrease in charging potential of the surface of the photosensitive drum 1 at a time when the cleaning voltage Vc is OFF (0 V) is smaller during the second time-period W2 as compared to that during the first time-period W1. That is, the duty ratio during the second time-period W2 is larger than that during the first time-period W1.

Thus, during the first time-period W1 of the cleaning mode for the charging roller 2, an electric field is formed, which has an action of actively transferring, among the particles adhered to the surface of the charging roller 2, the negatively charged particles onto the surface of the photosensitive drum 1 rather than the positively charged particles.

During the second time-period W2, the period t2*a* (time) at a time of OFF of the cleaning voltage Vc is short. With this, the dark decay amount during the second time-period W2 is smaller than that during the first time-period W1, and an electric field having an action of transferring the positively charged particles adhered to the surface of the charging roller 2 onto the surface of the photosensitive drum 1 can be sufficiently ensured.

In this embodiment, the duty ratio of the cleaning voltage Vc that is an AC voltage is changed between the first time-period W1 and the second time-period W2. With this, the bipolar particles adhered to the surface of the charging roller 2 can be removed efficiently. As a result, stable charging performance can be kept over a long period of time while the occurrence of an image defect, such as a streaked image, is prevented, to thereby output a high quality image. The other configuration is the same as that of each embodiment, and the same effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-188330, filed Sep. 25, 2015, which is hereby incorporated by reference herein in its entirety.

What is claimed is:

1. An image forming apparatus, comprising:

an image bearing member;

a charging member configured to charge the image bearing member;

a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a period of the first AC voltage is different from a period of the second AC voltage, wherein a peak-to-peak voltage value of the first AC voltage is the same as a peak-to-peak voltage value of the second AC voltage, and wherein the first and second AC voltages are non-sinusoidal.

2. An image forming apparatus according to claim 1, wherein the second time-period is provided after the first time-period, and the period of the first AC voltage is longer than the period of the second AC voltage.

3. An image forming apparatus according to claim 2, wherein a negatively charged particle is mainly transferred from the charging member onto the image bearing member during the first time-period, and a positively charged particle is mainly transferred from the charging member onto the image bearing member during the second time-period.

4. An image forming apparatus, comprising:

an image bearing member;

a charging member configured to charge the image bearing member;

a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a period of the first AC voltage is different from a period of the second AC voltage, and wherein a moving speed of the surface of the image bearing member during the first time-period is different from a moving speed of the surface of the image bearing member during the second time-period.

5. An image forming apparatus according to claim 2, wherein a moving speed of the surface of the image bearing member during the first time-period is lower than a moving speed of the surface of the image bearing member during the second time-period.

6. An image forming apparatus, comprising:

an image bearing member;

a charging member configured to charge the image bearing member;

a voltage applying device configured to apply a voltage to the charging member; and a control unit configured to control the voltage applying device so as to perform a cleaning mode for applying an AC voltage to the charging member with the voltage applying device while moving a surface of the image bearing member during non-image formation of the image forming apparatus, wherein a period of time during which the cleaning mode is performed includes a first time-period during which a first AC voltage is applied and a second time-period during which a second AC voltage is applied, and a duty ratio of the first AC voltage is different from a duty ratio of the second AC voltage.

7. An image forming apparatus according to claim 6, wherein the second time-period is provided after the first time-period, and the duty ratio of the second AC voltage is larger than the duty ratio of the first AC voltage.

8. An image forming apparatus according to claim 7, wherein a negatively charged particle is mainly transferred from the charging member onto the image bearing member during the first time-period, and a positively charged particle is mainly transferred from the charging member onto the image bearing member during the second time-period.

* * * * *